US005909022A

United States Patent [19]

Bourke et al.

[11] Patent Number: 5,909,022

[45] **Date of Patent: *Jun. 1, 1999**

[54] DUAL OUTLET PULP LEVEL CONTROL SYSTEM FOR FLASH FLOTATION DEVICES

[75] Inventors: Peter Bourke, Forrestfield, Australia; Jouko Kallioinen, Hollola, Finland

[73] Assignee: Outokumpu Mintec Oy, Espoo, Finland

[ * ] Notice: This patent is subject to a terminal disclaimer.

[21] Appl. No.: 08/846,775

[22] Filed: Apr. 30, 1997

[30] Foreign Application Priority Data

May 1, 1996 [AU] Australia ..... 9612/96

[51] Int. Cl.[6] ..... B03D 1/16; B03D 1/14; B03B 13/00

[52] U.S. Cl. ..... 209/164; 209/1; 209/169; 209/168; 209/170

[58] Field of Search ..... 209/168, 169, 209/170, 1, 164

[56] References Cited

U.S. PATENT DOCUMENTS 2,107,289 2/1938 Denny .
4,078,026 3/1978 Fallenius .
5,687,609 11/1997 Schmalzel .

FOREIGN PATENT DOCUMENTS 1226805 3/1971 United Kingdom .

OTHER PUBLICATIONS

Claridge, P.G., "Operation and Maintenance in Mineral Processing Plants"; The Canadian Institute of Mining and Metallurgy 1989, pp. 267–290.

*Primary Examiner*—Thomas M. Lithgow
*Attorney, Agent, or Firm*—Smith-Hill and Bedell

[57] ABSTRACT

A flash flotation device (1) comprises a tank (2) to contain slurry (3) incorporating minerals to be extracted, a feed inlet (25) for admission of slurry (3) into the tank (2), agitation means (10) to agitate the slurry (3) within the tank (2), aeration means to aerate the slurry (3) whereby floatable minerals in suspension form a surface froth for removal via froth lip (29), a bottom outlet (26) for withdrawal of relatively coarse or dense components of the slurry (3) from the tank (2), and a side outlet (28) to regulate the level of slurry (3) in the tank (2).

4 Claims, 1 Drawing Sheet

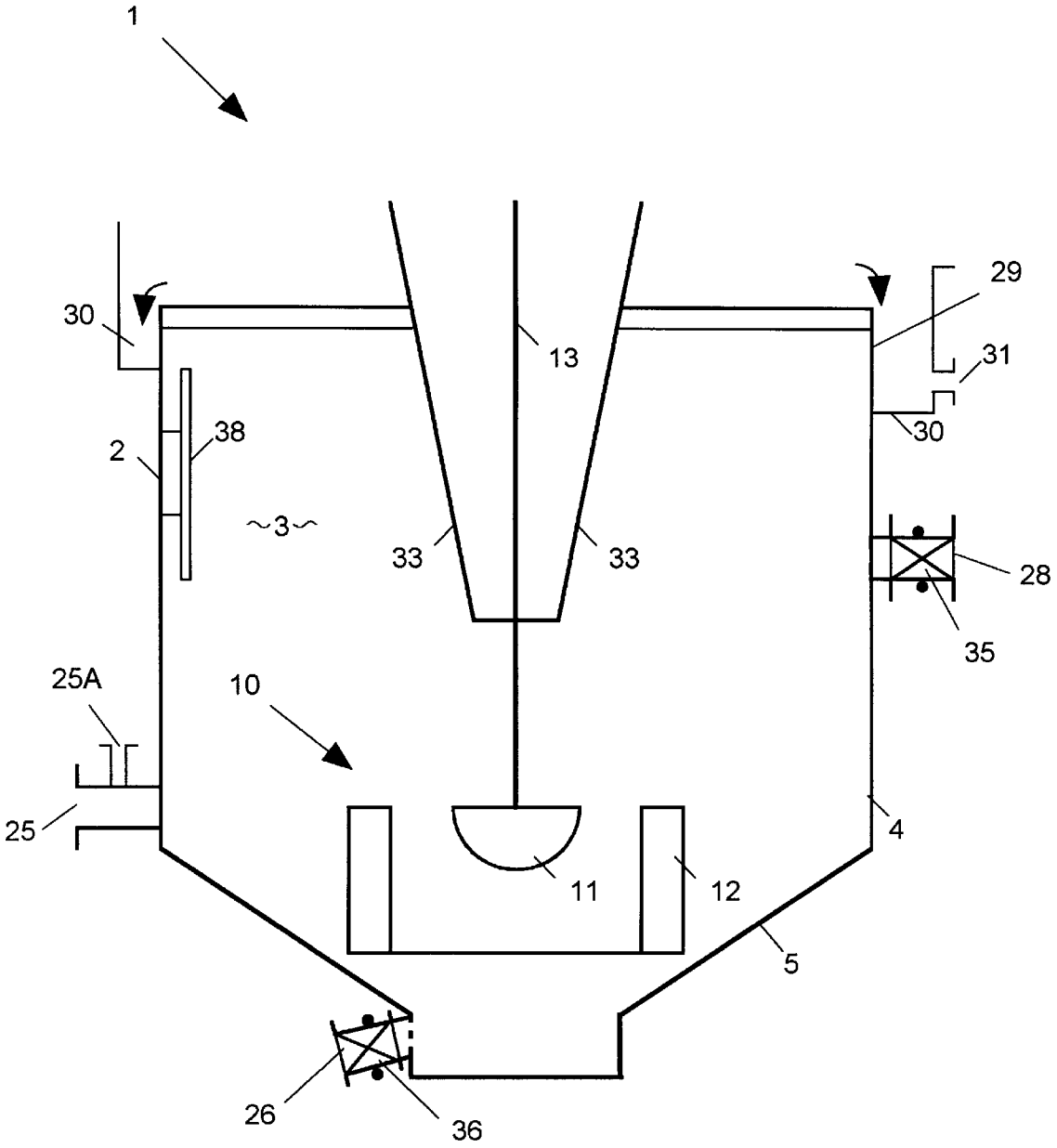
1
30
29
13
31
38
2
30
3
33
33
28
35
25A
10
25
4
11
12
5
26
36

DUAL OUTLET PULP LEVEL CONTROL SYSTEM FOR FLASH FLOTATION DEVICES

BACKGROUND OF THE INVENTION

The present invention relates to flotation devices of the type used in mineral separation, and more particularly to flash flotation devices.

Flash flotation cells are well known, and typically comprise a tank to receive and contain slurry from a grinding mill, cyclone separator, or the like. An agitator, comprising a rotor housed within a stator, is normally disposed within the tank to agitate the slurry. An aeration system is also provided to direct air under pressure into the agitator through a central conduit formed within the drive shaft. As the bubbles from the aeration system rise toward the surface of the tank, they carry with them floatable particles which form a mineral enriched surface froth. The froth then migrates over a lip and into a launder whereby the floatable particles suspended in the froth are removed from the cell as mineral concentrate. Coarser and denser particles fall from suspension, for removal through a discharge outlet formed in the bottom of the tank. An automatic control system, typically incorporating a liquid level sensor and a PID controller, regulates a control valve in the bottom discharge outlet, to maintain a constant liquid level in the tank.

In the past, however, problems have arisen in regulating the flow through the bottom discharge outlet, because most conventional valve assemblies are incapable of accommodating coarse material of the type which typically emerges from grinding mills.

In an attempt to address this problem, it has been common practise to use pinch valves. These essentially comprise a flexible tube or sleeve positioned in a fluid pipeline and adapted for compression between opposing pinch bars to provide progressive regulation of fluid flow through the pipeline. Such valves are typically more accommodating of larger particles than most other types of valve because of the flexibility of the sleeve. However, even with pinch valves, rapid wear is caused by the coarse and often jagged particles. This problem is exacerbated when the valve is used for control purposes because the flow is both fast and turbulent. This necessitates frequent replacement of the pinch valve sleeves. Aside from the ongoing sleeve replacement costs, the associated downtime has a considerable adverse affect on the efficiency of the plant as a whole.

It is therefore an object of the present invention to overcome or substantially ameliorate at least some of these disadvantages of the prior art.

SUMMARY OF THE INVENTION

Accordingly, the invention as presently contemplated consists in a flash flotation device comprising a tank to contain slurry incorporating minerals to be extracted, a feed inlet for admission of slurry into the tank, agitation means to agitate the slurry within the tank, aeration means to aerate the slurry whereby floatable minerals in suspension form a surface froth for removal via a froth lip, a bottom outlet for withdrawal of relatively coarse or dense components of the slurry from the tank, and a side outlet to regulate the level of slurry in the tank.

Preferably, the agitation means includes a rotor supported for rotation within a surrounding stator, and operable by means of central drive shaft extending downwardly into the tank.

The aeration means preferably comprises an air compressor and a fluid conduit for directing air from the compressor into the agitator. The conduit preferably includes an axial bore extending through the drive shaft of the rotor.

Preferably, the side outlet includes the first control valve in the form of a first pinch valve, regulated via a PID controller in response to an output signal from a liquid level sensor, to maintain the liquid in the tank at a predetermined level. Alternatively, the side outlet can be defined by an overflow weir plate arrangement, the effective height of which may be adjustable to regulate liquid level in the tank. The first outlet may also be inclined in any orientation.

The bottom outlet preferably includes a second control valve to provide secondary regulation of fluid flow through the tank. The second control valve preferably also takes the form of a pinch valve.

A lower portion of the tank is preferably conical in shape such that the relatively dense and coarse components of the slurry are directed toward the bottom outlet upon settling from solution or suspension.

In the preferred embodiment of the invention, mineralised froth migrating across the overflow lip is collected in an overflow launder for recovery and further concentration.

BRIEF DESCRIPTION OF THE DRAWINGS

A preferred embodiment of the invention will now be described, by way of example only, with reference to the accompanying drawing which is a diagrammatic cross-sectional side elevation showing a flash flotation cell according to the invention.

DETAILED DESCRIPTION

Referring to the drawing, the invention provides a flash flotation cell 1 comprising a tank 2 to contain a slurry 3 incorporating minerals to be extracted. The tank is defined by generally cylindrical side walls 4, a conical bottom section 5, and an open top.

An agitation mechanism 10 is disposed to agitate the slurry within the tank. The agitator comprises a rotor 11 supported for rotation within a surrounding stator 12. The rotor is driven via a central drive shaft 13 extending downwardly into the tank.

The flotation cell further includes an aeration system comprising an air compressor and a fluid conduit (not shown) to direct air from the compressor into the agitator. The conduit is defined in part by an axial bore extending through the drive shaft 13 of the rotor.

Feed slurry is introduced into the tank 2 via a feed inlet 25 formed in the sidewall of the tank. If and when required, dilution water may also be introduced simultaneously via associated water inlet 25A or by other suitable means. A bottom outlet 26 is formed in the lower conical section 5 of the tank. A side outlet 28 is similarly formed in the side wall of the tank. The top of the tank is defined by a froth overflow lip 29 which drains into a surrounding overflow launder 30. The overflow launder in turn drains into a top froth outlet 31. A conical baffle plate 33 directs upwardly migrating froth progressively outwardly toward the overflow froth lip 29.

Flow through the side outlet is regulated by a first control valve 35, preferably in the form of a pinch valve. Flow through the bottom outlet is regulated by a second control valve 36, which in the preferred embodiment is also a pinch valve although it will be appreciated that any suitable form of valve may be used in either case. The first control valve 35 is regulated automatically via a proportional integral differential (PID) controller 37 in response to an output signal from a liquid level sensor 38 so as to control throughput and maintain the liquid in the tank at a preset level. Optionally, the second control valve 36 may be regulated in the same way.

Turning now to describe the operation of the flotation cell in more detail, slurry is initially fed into the tank via feed inlet 25, from where it migrates generally downwardly toward the agitation and aeration assemblies positioned near the bottom of the tank. The combined agitation and aeration action creates bubbles and froth which migrate upwardly toward the surface and in the process, entrain smaller and lighter particles suspended in the slurry, including the desired mineral species. Near the surface, the mineralised froth migrates progressively outwardly along inclined baffle plates 33, over the peripheral overflow weir 29, and into the overflow launder 30. From there, the mineral enriched overflow is recovered through top outlet 31.

At the same time, relatively coarse and dense components of the slurry settle in the bottom conical section 5 of the tank for removal through bottom outlet 26 as and when the associated second control valve 36 permits. The side outlet 28 simultaneously permits the outflow of intermediate components of the slurry, through the first control valve 35 which is responsive to a feedback loop from the liquid level sensor in the tank via the PID controller. In this way, the first control valve 35 in the side outlet maintains a dynamic equilibrium between the various inflows and outflows, and maintains the liquid in the tank at a predetermined level.

It should be noted that unlike conventional flash flotation cells, the bottom outlet in the present invention is not required as a primary control to regulate the outflow of pulp from the tank in order to maintain a stable liquid level, since this function is performed by the side outlet and associated first control valve. In principle therefore, the bottom valve could be permanently open and the level control function performed entirely by the first control valve associated with the side outlet. With the bottom control valve open, coarse particles can pass freely from the tank through the bottom outlet without obstructing flow or affecting the liquid level. In this configuration, the wear rate of the second control valve at the bottom of the tank, and hence the plant availability of the cell overall, is significantly improved because the bottom valve is not required to frequently compress on abrasive particles in order to control the level in the tank. The wear rate of the first control valve is also low, because this valve, although performing the primary flow regulation and level control functions, is not subject to large or coarse particles since these drain through the bottom outlet. Furthermore, because the hydraulic pressure head at the side outlet is relatively low, the flow velocity and turbulence in the first control valve are correspondingly reduced, resulting again in longer sleeve life in the pinch valve.

It should also be appreciated, however, that the second control valve could be used in conjunction with the first (side) control valve as a secondary mechanism to regulate flow, particularly in environments involving significant variations in flow rate. For example, the second valve at the bottom of the tank may be required to partially close from time to time, or to operate in series with the first valve at the side outlet. However, even in such cases, because the substantial proportion of the flow regulation load is borne by the first control valve at the side outlet, and because the second control valve need not fully close, dramatic improvements in reliability and wear rates are still achieved. Thus, the invention represents a commercially significant improvement over the prior art.

Although the invention has been described with reference to specific examples, it will be appreciated by those skilled in the art that the invention may be embodied in many other forms.

We claim:

1. A flotation device for extracting floatable minerals from a slurry, the flotation device including:

a tank having a feed inlet for admitting the slurry to the tank, a top outlet for progressive removal of material from an upper zone of the tank, a bottom outlet for progressive removal of material from a lower zone of the tank, and a side outlet for progressive removal of material from an intermediate zone of the tank, a first control valve for controlling removal of material from the side outlet, a second control valve for controlling removal of slurry from the bottom outlet, a level sensor for detecting level of the free surface of the slurry in the tank, and a primary control means which exercises primary control over the level of the free surface of the slurry by controlling the first control valve in response to the level sensor so as to maintain the free surface of the slurry in the tank at a substantially constant level.

2. A flotation device according to claim 1, wherein the first and second control valves are pinch valves.

3. A method of operating a flotation device which includes a tank having a feed inlet for admitting slurry to the tank, a top outlet for progressive removal of material from an upper zone of the tank, a bottom outlet for progressive removal of material from a lower zone of the tank, and a side outlet for progressive removal of material from an intermediate zone of the tank, a first control valve for controlling removal of material from the side outlet, a second control valve for controlling removal of slurry from the bottom outlet, and a level sensor for detecting level of free surface of the slurry in the tank, the method comprising:

exercising primary control over the level of the free surface of the slurry by controlling the first control valve in response to the level sensor so as to maintain the free surface of the slurry in the tank at a substantially constant level.

4. A method according to claim 3, comprising controlling the second control valve so that it remains open substantially permanently.

* * * * *